US005730224A

United States Patent [19]

Williamson et al.

[11] Patent Number: 5,730,224

[45] Date of Patent: Mar. 24, 1998

[54] SLIDABLE ACCESS CONTROL DEVICE FOR SUBTERRANEAN LATERAL WELL DRILLING AND COMPLETION

[75] Inventors: Jimmie R. Williamson, Carrollton; Dan R. Collins, The Colony, both of Tex.

[73] Assignee: Halliburton Energy Services, Inc., Dallas, Tex.

[21] Appl. No.: 609,100

[22] Filed: Feb. 29, 1996

[51] Int. Cl.[6] ..... E21B 23/14; E21B 34/14

[52] U.S. Cl. ..... 166/386; 166/50; 166/177.6; 166/332.4

[58] Field of Search ..... 166/50, 117.6, 166/386, 332.4

[56] References Cited

U.S. PATENT DOCUMENTS

| | | | |
|---|---|---|---|
| 3,073,392 | 1/1963 | Dinning et al. | 166/332.4 |
| 4,928,772 | 5/1990 | Hopmann | 166/386 |
| 5,090,481 | 2/1992 | Pleasants et al. | 166/386 |
| 5,355,953 | 10/1994 | Shy et al. | 166/386 X |
| 5,390,742 | 2/1995 | Dines et al. | 166/386 X |
| 5,479,989 | 1/1996 | Shy et al. | 166/332.4 |

FOREIGN PATENT DOCUMENTS

| | | |
|---|---|---|
| WO 94/29562 | 6/1994 | WIPO . |
| WO 94/29568 | 6/1994 | WIPO . |

*Primary Examiner*—Hoang C. Dang
*Attorney, Agent, or Firm*—William M. Imwalle; Paul I. Herman

[57] ABSTRACT

The present invention provides a subterranean structure for controlling tool access to a lateral wellbore extending from a wellbore. The subterranean structure comprises a bushing that is located in the wellbore and proximate an opening to the lateral wellbore and that has an access window therethrough for allowing access by a tool to the lateral well through the opening. The bushing further has a slidable access control device coaxially coupled thereto. Also included is a shifter that is engagable with the slidable access control device to cause the slidable access control device to slide between an open position wherein a tool is allowed to pass through the window and the opening and into the lateral wellbore and a closed position wherein the tool is prevented from passing through the window and the opening and into the lateral wellbore. The present invention also provides a method of controlling tool access to a lateral wellbore extending from a wellbore. The preferred method comprises the steps of: 1)locating a bushing in the wellbore proximate an opening to the lateral wellbore, the bushing having an access window therethrough for allowing access by a tool to the lateral wellbore through the opening, the bushing further having a slidable access control device coaxially coupled thereto; 2)engaging the slidable access control device with a shifter to slide the slidable access control device with respect to the bushing; and 3) sliding the slidable access control device between an open position wherein a tool is allowed to pass through the window and the opening and into the lateral wellbore and a closed position wherein the tool is prevented from passing through the window and the opening mad into the lateral wellbore.

64 Claims, 9 Drawing Sheets

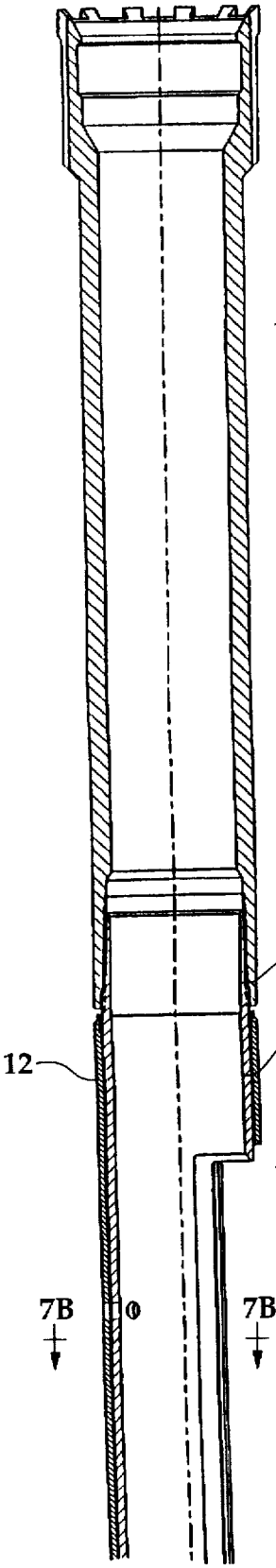
Fig.7A
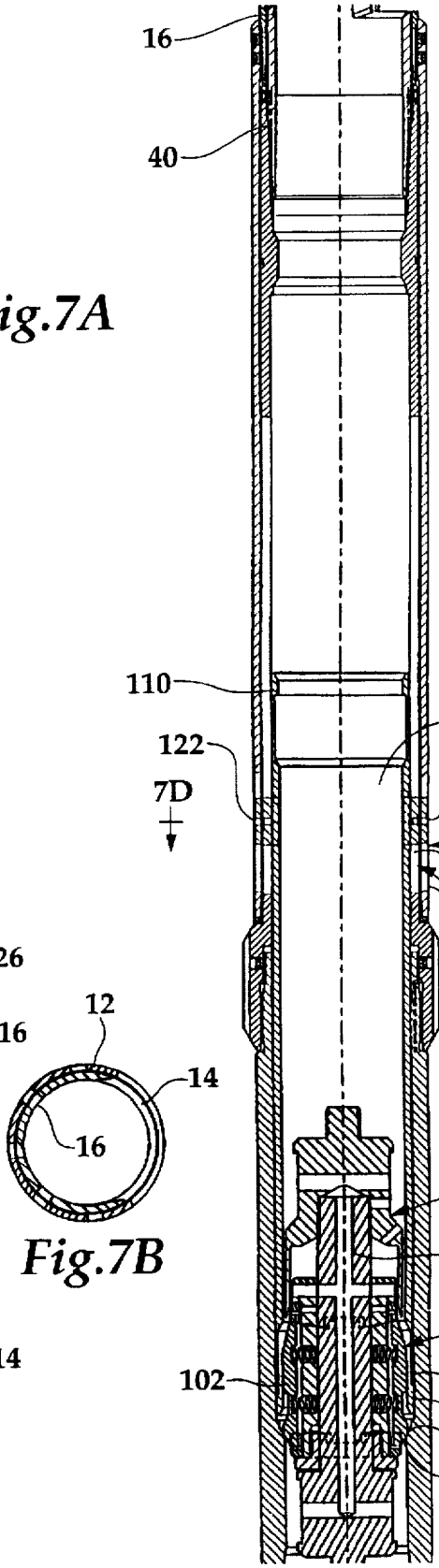
Fig.7C
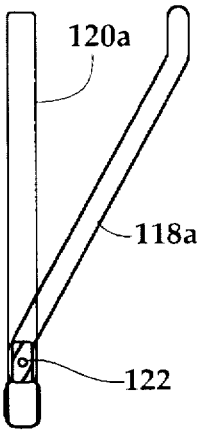
Fig.7E
Fig.7B
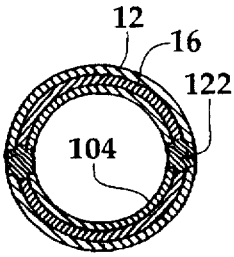
Fig.7D

SLIDABLE ACCESS CONTROL DEVICE FOR SUBTERRANEAN LATERAL WELL DRILLING AND COMPLETION

TECHNICAL FIELD OF THE INVENTION

The present invention is directed, in general, to well methods and systems for drilling and completing subterranean lateral wells, and more specifically, it is directed to a slidable access control device that is movable within a well flow conductor to expose an access window to thereby allow access to a lateral wellbore or to substantially block access to a lateral wellbore and a main wellbore conductor.

BACKGROUND OF THE INVENTION

Horizontal well drilling and production have become increasingly important to the oil industry, in recent years. While horizontal wells have been known for many years, only recently have such wells been determined to be a cost-effective alternative to conventional vertical well drilling. Although drilling a horizontal well costs substantially more than its vertical counterpart, a horizontal well frequently improves production by a factor of five, ten or even twenty in naturally-fractured reservoirs. Generally, projected productivity from a horizontal wellbore must triple that of a vertical wellbore for horizontal drilling to be economical. This increased production minimizes the number of platforms, cutting investment and operational costs. Horizontal drilling makes reservoirs in urban areas, permafrost zones and deep offshore waters more accessible. Other applications for horizontal wellbores include periphery wells, thin reservoirs that would require too many vertical wellbores, and reservoirs with coning problems in which a horizontal wellbore could be optimally distanced from the fluid contact.

Also, some horizontal wellbores contain additional wellbores extending laterally from the primary vertical wellbores. These additional lateral wellbores are sometimes referred to as drainholes and vertical wellbores containing more than one lateral wellbore are referred to as multilateral wells. Multilateral wells are becoming increasingly important, both from the standpoint of new drilling operations and from the increasingly important standpoint of reworking existing wellbores, including remedial and stimulation work.

As a result of the foregoing increased dependence on mad importance of horizontal wells, horizontal well completion, and particularly multilateral well completion, have been important concerns and continue to provide a host of difficult problems to overcome. Lateral completion, particularly at the juncture between the main and lateral wellbores, is extremely important to avoid collapse of the wellbore in unconsolidated or weakly consolidated formations. Thus, open hole completions are limited to competent rock formations; mad, even then, open hole completions are inadequate since there is no control or ability to access (or reenter the lateral) or to isolate production zones within the wellbore. Coupled with this need to complete lateral wellbores is the growing desire to maintain the lateral wellbore size as close as possible to the size of the primary vertical wellbore for ease of drilling and completion.

The above concerns can be summarized in three main objectives: connectivity, isolation and access. Connectivity refers to the mechanical coupling of casings in the main and lateral wellbores such that there are no open hole sections between casings. This ensures that the multilateral completion is not subject to collapse of a section of open hole and that open hole tools are not required in order to access portions of the completion.

Isolation refers to the ability to seal off one or more wellbores, or any selectable portion thereof, without impeding production from remaining wellbores or portions. To isolate one wellbore from another effectively, the casings in the wellbores must be hydraulically sealed (generally up to 5000 psi) to one another to allow the multilateral completion as a whole to withstand hydraulic pressure. Hydraulic sealing is particularly important at the juncture between main and lateral wellbores. Without hydraulic sealing, either pressure is lost into the void that surrounds the casing or fluid or particulate contaminates are allowed to enter the casing from the surrounding void. While connectivity, isolation and access are important in both horizontal and vertical wells, they are particularly important and pose particularly difficult problems in multilateral well completions. As mentioned above, isolating one lateral wellbore from other lateral wellbores is necessary to prevent migration of fluids and to comply with completion practices and regulations regarding the separate production of different production zones. Zonal (or partial wellbore) isolation may also be needed if the wellbore drifts in and out of the target reservoir because of insufficient geological knowledge or poor directional control. When horizontal wellbores are drilled in naturally-fractured reservoirs, zonal isolation is seen as desirable. Initial pressure in naturally-fractured formations may vary from one fracture to the next, as may the hydrocarbon gravity and likelihood of coning. Allowing the formations to produce together permits crossflow between fractures. A single fracture with early water breakthrough may jeopardize the entire well's production.

Access refers to the ability to reenter a selected one of the wellbores to perform completion work, additional drilling or remedial and stimulation work, preferably without requiring a full drilling rig. In the most preferable situation, any one of the lateral wellbores can be entered with a completion, work-over tool, or some other tool, thereby saving money. In most instances, the window through which access is achieved must be very large to accommodate various size tools and to provide the space required to manipulate the tool within the selected lateral wellbore. Moreover, in certain applications, it is important to achieve a fluid tight seal between the main wellbore and the lateral wellbore to allow production from reservoirs downhole from entering the lateral wellbore or to allow drilling fluids to pass through the main wellbore without entering the selected lateral wellbore.

Only until recently has the ability to access one or more lateral wellbores from a wellbore become important within the exploration industry. Present prior an devices do not address the more recent needs arising from multilateral wellbore operations. Prior art devices, such as circulation/production devices, presently use sliding sleeves to open and close small ports that are used for circulation and production purposes. However, the overall design of these devices are specifically engineered to provide controlled circulation and production and as such do not allow access by tools into a lateral wellbore. Consequently, these devices are totally ineffective for the more recent problems of completing, producing and working-over a wellbore with one or more lateral wellbores extending therefrom. Since these prior art devices are designed for controlled circulation and production, the ports are small and designed for circulation or production across a given geological zone. As such, they are not suited where there is a large window involved for allowing access to the lateral wellbore because the large size of the window may extend across more than one geological zone causing undesirable variances in the production or circulation systems. Moreover, it is highly desirable that a seal be maintained at all times between the sleeve and the bushing in which it operates. As such, the circulation/production prior art devices are not designed to completely disengage the sleeve from the bushing in which it operates to provide an access window proximate a lateral wellbore that is sufficiently large to accommodate completion, production or work-over tools, which would restrict full access to the lateral wellbore. In many applications involving lateral wellbore operations, it is necessary that the entire window be available for operations within the lateral wellbore because restricted operating space can lead to a tool getting caught and hanging up within the wellbore. Operations to free the tool are costly in both time and money. Therefore, it is important to have as much space as possible available for the lateral wellbore operations.

Therefore, what is needed in the art is a slidable access control device that provides an apparatus and method for opening and closing an access window within a bushing that is positioned proximate a lateral wellbore and that is large enough to accommodate various tool sizes necessary to perform operations regarding a lateral wellbore. The apparatus and methods of the present invention addresses these deficiencies presently found in the prior art devices discussed above.

SUMMARY OF THE INVENTION

In one aspect of the present invention, there is provided a method of controlling tool access to a lateral wellbore extending from a wellbore. In a preferred embodiment, the method comprises the steps of: 1)locating a bushing in the wellbore proximate an opening to the lateral wellbore, the bushing having an access window therethrough for allowing access by a tool to the lateral wellbore through the opening, the bushing further having a slidable access control device coaxially coupled thereto; 2) actuating the slidable access control device with a shifter to slide the slidable access control device with respect to the bushing; and 3) sliding the slidable access control device between an open position wherein a tool is allowed to pass through the window and the opening and into the lateral wellbore and a closed position wherein the tool is prevented from passing through the window and the opening and into the lateral wellbore. As used herein the term "access window" means a window sufficiently large enough to accommodate tools, such as completion tools, production tools, work-over tools or plugging tools used in operations involving lateral wellbores.

Thus, the method of the present invention provides a method of easily accessing a lateral wellbore for completion, production or work-over purposes through an access window formed within the bushing that is positioned proximate the lateral wellbore. When operations within the wellbore or downhole from the lateral wellbore are required, access to the lateral wellbore can be closed off by sliding a slidable access control device across the open window portion of the bushing. The sliding may either be along the longitudinal axis of the wellbore, or it may be rotational with respect to the longitudinal axis of the wellbore. In either case, the window can be easily opened and closed as required.

In another preferred embodiment of the method, a seal is coupled to one of the slidable access control device and the bushing and the method further comprises the step of disengaging the seal from one of the slidable access control device and the bushing when the slidable access control device slides from the closed position to the open position. In some instances, it is desirable to form a seal, preferably a pressure tight seal, between the wellbore and the lateral wellbore. In such instances, the seal will be disengaged when the slidable access control device is moved from the closed position to the open position and will be re-engaged with one of the slidable access control device and the bushing when the slidable access control device slides from the open position to the closed position.

In another aspect of the present method, the step of actuating the slidable access control device with the shifter includes the step of engaging a shifting profile associated with the slidable access control device to slide the slidable access control device between the open and closed positions. More preferably, however, there are two such profiles associated with the slidable access control device; an opening profile and a closing profile. Thus, in one aspect, the step of engaging a shifting profile includes engaging an opening shifting profile to slide the slidable access control device from the closed position to the open position. Additionally, the step of engaging a shifting profile may include engaging a closing shifting profile to slide the slidable access control device from the open position to the closed position. This arrangement allows the window to be opened and closed by simply reciprocating the shifter back and forth with in the wellbore. However, in other embodiments, the step of actuating the slidable access control device between the open and closed positions may be accomplished by a number of mechanical or electrical systems, such as a hydraulic system that shifts the slidable access control device between the closed and open positions or an electrical or electromagnetic sytems. The hydraulic system may be a separate system, such as a hydraulic piston that is coupled to the slidable access control device, or it may be integral with the slidable flow control device itself. Whichever system is used, the slidable flow control device is easily shifted between the open and closed positions.

In yet another aspect of the present invention, the method further comprises the step of setting a deflector within the wellbore into a diverting position to divert tools from the wellbore and into the lateral wellbore. Preferably, the shifter is coupled to the deflector and the step of setting the deflector includes the step of engaging an opening shifting profile with the shifter and sliding the slidable access control device from the closed position to the open position. In a preferred embodiment, the step of setting the deflector includes the step of orienting and locking the deflector with an orienting lock coupled to the deflector, which includes the step of positioning the orienting lock into an orienting and locking profile coupled to the bushing. Thus, this method eliminates the need for additional tools and trips into the wellbore since the deflector may provide the mechanism by which to open the window.

Similarly, the method may also include the step of removing a deflector from the wellbore. In such instances, the shifter is preferably coupled to the deflector and the step of removing the deflector includes the step of engaging a closing shifting profile with the shifter and sliding the slidable access control device from the open position to the closed position. Thus, this aspect of the method is simply the counterpart to the method just discussed above and provides the advantage of eliminating the need for additional tools and trips into and out of the wellbore since the deflector may provide the mechanism by which to close the window.

In another aspect of the method, the step of actuating the slidable flow control device with the shifter includes the step of coupling the shifter to an actuator wherein the actuator is selected from the group consisting of a running took a pulling tool and a wireline tool.

In another aspect, the step of sliding includes rotating the slidable access control device about a longitudinal axis of the bushing with the shifter. In this particular embodiment, the shifter may include numerous mechanical systems, hydraulic systems, electromechanical, electrical systems, or electromagnetic sytems. More preferably, however, the shifter is a shifting sleeve coupled to the slidable access control device along a longitudinal axis of the wellbore that rotates the slidable access control device about a longitudinal axis of the bushing with the shifting sleeve as the shifting sleeve is reciprocated along the longitudinal axis of the wellbore. In this particular embodiment, the window is opened and closed via rotation of the slidable access control device about the bushing. Preferably, the step of actuating the slidable access control device with the shifter includes the step of engaging a shifting profile of the shifting sleeve with the shifter to slide the shifting sleeve along the longitudinal axis of the wellbore and thereby rotating the slidable access control device between the open and closed positions. In such instances, it is also preferable that the step of engaging the shifting sleeve with the shifter includes engaging an opening shifting profile of the shifting sleeve to rotate the slidable access control device from the closed position to the open position and that the step of engaging the shifting sleeve with the shifter also includes engaging a closing shifting profile of the shifting sleeve to rotate the slidable access control device from the open position to the closed position.

In this particular aspect, it is preferred that the step of sliding includes directing a follower through cams associated with the shifting sleeve and the slidable access control device. The cams are positioned relative to one another to slide the slidable access control device by rotating the slidable access control device about a longitudinal axis of the bushing between the open and closed positions as the shifting sleeve is slid along the longitudinal axis of the wellbore. More preferably, however, the step of directing a follower includes concurrently moving a camming lug along a first cam associated with the shifting sleeve and a second cam associated with the slidable access control device. The camming lug extends through the first and second cams, and the first and second cams are offset at a predetermined angle with respect to one another, preferably to impart a rotation of about 120° of the slidable access control device with respect to the bushing. In a preferred embodiment, the step of moving the camming lug along the first cam includes moving the camming lug along a slot formed in and along a longitudinal axis of the shifting sleeve and the step of moving the camming lug along the second cam includes moving the camming lug along a helical slot formed in and around a longitudinal axis of the slidable access control device.

In another aspect of the method of controlling tool access to a lateral wellbore extending from a wellbore, the method may further comprise the step of sliding the slidable flow control device to open a fluid port to thereby establish fluid communication between the bushing and the wellbore. In certain applications, it may be necessary to circulate the fluid system of the well prior to or after conducting accessing operations to the lateral wellbore. In such instances, it is desireable to open or close fluid ports that will allow fluid communication between the interior of the bushing and the annulus of the wellbore. Preferably, this is accomplished by only partially sliding the slidable access control device. What is meant by "partially sliding" is that the slidable access control device is slid only until the fluid ports within the slidable access control device and the bushing align to allow a fluid communication but the window in the bushing remains completely closed (i.e., there is no fluid communication from the window). However, them may be those instances where the window may be partially opend whenever the fluid ports are aligned.

In another aspect of the present invention, there is provided a subterranean structure for controlling tool access to a lateral wellbore extending from a wellbore. The subterranean structure comprises a bushing that is located in the wellbore and proximate an opening to the lateral wellbore and that has an access window therethrough for allowing access by a tool to the lateral well through the opening. The bushing further has a slidable access control device coaxially coupled thereto. Also included is a shifter that is coupled to the slidable access control device to cause the slidable access control device to slide between an open position wherein a tool is allowed to pass through the window and the opening and into the lateral wellbore and a closed position wherein the tool is prevented from passing through the window and the opening and into the lateral wellbore. A distinct advantage of this particular invention over those of the above discussed prior art is that the window is sufficiently large to pass tools therethrough and provides adequate room to properly operate the tools. The prior art circulation/production devices discussed above, of course, do not possess these advantages because it is not feasible to have openings large enough to accommodate tools such as completion, production, work-over or plugging devices because such openings would interfere with proper operation of the circulation/production devices. However, as discussed below, the slidable access control device may include fluid ports that may be opened and closed with a partial sliding action of the slidable access control device to allow fluid communication between the inerior of the bushing and the wellbore.

In a preferred embodiment, the subterranean structure further comprises a seal coupled to one of the slidable access control device and the bushing. The seal disengages from one of the slidable access control device and the bushing when the slidable access control device slides from the closed position to the open position and re-engages one of the slidable access control device and the bushing when the slidable access control device slides from the open position to the closed position. As previously mentioned, this particular aspect provides a seal that preferably prevents fluids from passing between the lateral wellbore and the wellbore when the window is closed. In a preferred embodiment, the seal is integral with an interior wall of the bushing and forms a seal between the inner wall of the bushing and the outer wall of the slidable access control device.

In a preferred embodiment, the slidable access control device includes a shifting profile associated therewith, and the shifter is engageable with the shifting profile to slide the slidable access control device between the open and closed positions. The shifting profile preferably includes an opening shifting profile where the shifter is engagable with the opening shifting profile to slide the slidable access control device from the closed position to the open position. The subterranean structure may also include a closing shifting profile where the shifter is engagable with the closing shifting profile to slide the slidable access control device from the open position to the closed position. More preferably, however, both the opening and closing shifting profiles are present.

In another aspect of the present invention, the subterranean structure further comprises a deflector positionable within the wellbore to divert the tool from the wellbore and into the lateral wellbore. Preferably, the shifter is coupled to the downhole end of the deflector, and the shifter is configured to engage an opening shifting profile to slide the slidable access control device from the closed position to the open position as the deflector is positioned within the wellbore. The shifter may also be configured to engage a closing shifting profile to slide the slidable access control device from the open position to the closed position as the deflector is removed from the wellbore. More preferably, however, the shifter is configured to engage both the opening shifting profile and the closing shifting profile.

The deflector may also include an orienting lock coupled to the deflector to thereby orient and lock the deflector in a diverting position with respect to the lateral wellbore. In such instances, the bushing preferably includes an orienting and locking profile coupled to the bushing where the orienting and locking profile is configured to engage the orienting lock to thereby orient and lock the deflector in the diverting position with respect to the lateral wellbore.

In another aspect of the present invention, the subterranean structure further comprises an actuator configured to engage the shifter. Preferably, the actuator is selected from the group consisting of a running tool, a pulling tool and a wireline tool.

In yet another aspect of the present invention, the shifter further comprises a shifting sleeve that is coupled to the slidable access control device and has a shifting profile associated it. The shifting sleeve is positioned along a longitudinal axis of the wellbore for reciprocal movement with respect to the wellbore to rotate the slidable access control device about a longitudinal axis of the bushing. Preferably, the shifting sleeve is positioned on the interior of the wellbore with the slidable access control device positioned on the outer diameter of the bushing to cover the window when the slidable access control device is rotated about the bushing. The shifter preferably includes a shifting profile configured to engage the shifting profile of the shifting sleeve to reciprocate the shifting sleeve along the longitudinal axis of the wellbore. When these corresponding profiles are present, the profile of the shifter engages the profile of the shifting sleeve, which allows the shifting sleeve to be moved with the shifter. After the closing or opening operation is complete, the shifter, in a preferred embodiment, is disengaged from the shifting sleeve as it is removed from the wellbore.

In a more preferred embodiment, the shifting sleeve includes an opening shifting profile configured to engage the shifting profile of the shifter to reciprocate the shifting sleeve along the longitudinal axis of the wellbore and thereby rotate the slidable access control device from the closed position to the open position.

In yet another preferred embodiment, the shifting sleeve includes a closing shifting profile configured to engage the shifting profile of the shifter to reciprocate the shifting sleeve along the longitudinal axis of the wellbore and thereby rotate the slidable access control device from the opened position to the closed position. In a more preferred embodiment, however, both the opening and closing shifting profiles are present.

In another aspect of the present invention that includes the shifting sleeve, the subterranean structure further comprises a follower extending through cams associated with the shifting sleeve and the slidable access control device. The cams are positioned relative to one another and configured to allow the follower to concurrently move through the cams to thereby slide the slidable access control device by rotating the slidable access control device about a longitudinal axis of the bushing between the open and closed positions as the shifting sleeve is reciprocated along the longitudinal axis of the wellbore. Preferably, the follower causes the slidable access control device to rotate about 120° with respect to the longitudinal axis of the bushing.

In a preferred embodiment, the follower is a camming lug extending through and coupling a first cam associated with the shifting sleeve and a second cam associated with the slidable access control device. The first and second cams are offset at a predetermined angle with respect to one another. More preferably, however, the first cam is a slot formed in and along a longitudinal axis of the shifting sleeve, and the second cam is a helical slot formed in and around a longitudinal axis of the slidable access control device.

In yet another aspect of the present invention, there is provided a subterranean structure for controlling tool access to a lateral wellbore extending from a wellbore. In this particular embodiment, the subterranean structure comprises a bushing located in the wellbore and proximate an opening to the lateral wellbore. The bushing has an access window therethrough for allowing access by a tool to the lateral wellbore through the opening. Also included is a slidable access control device that is coaxially coupled to the bushing for reciprocal movement along a longitudinal axis of the bushing and that has a shifting profile associated therewith. This particular embodiment also includes a shifter associated with the slidable access control device that is engageable with the shifting profile: to slide the slidable access control device along a longitudinal axis of the bushing between an open position wherein a tool is allowed to pass through the window and the opening and into the lateral wellbore and a closed position wherein the tool is prevented from passing through the window and the opening and into the lateral wellbore.

In one aspect of this particular embodiment, the subterranean structure further comprises a seal coupled to one of the slidable access control device and the bushing. The seal disengages from one of the slidable access control device and the bushing when the slidable access control device reciprocates from the closed position to the open position and re-engages one of the slidable access control device and the bushing when the slidable access control device reciprocates from the open position to the closed position.

In another aspect, the shifting profile includes an opening shifting profile and a closing shifting profile. The shifter is releasably engagable with the opening shifting profile and the closing shifting profile to slide the slidable access control device between the open and closed positions. This allows the same shifter to both open and close the window with the slidable access control device.

In yet another aspect of this embodiment, the subterranean structure further comprises a deflector positionable within the wellbore to divert the tool from the wellbore and into the lateral wellbore. Preferably, the shifter is coupled to the deflector, and the shifter is configured to engage the opening shifting profile to slide the slidable access control device from the closed position to the open position as the deflector is moved downhole within the wellbore. In another preferred embodiment, the shifter is coupled to the deflector, and the shifter is configured to engage the closing shifting profile to slide the slidable access control device from the open position to the closed position as the deflector is moved uphole within the wellbore. The deflector preferably includes an orienting lock coupled to the deflector to thereby orient and lock the deflector in a diverting position with respect to the lateral wellbore. In such instances, the bushing also preferably includes an orienting and locking profile coupled to the bushing. The orienting and locking profile are configured to engage the orienting lock to thereby orient and lock the deflector in the diverting position with respect to the lateral wellbore.

An actuator that is configured to engage the shifter is also preferably present in this particular embodiment. The actuator is preferably selected from the group consisting of a running tool, a pulling tool and a wireline tool.

In another aspect of this particular embodiment, the bushing is coupled to a honed bore having a bore diameter less than a bore diameter of the bushing, and the shifter further comprises a biased shifter key. The shifter key has a profile configured to engage the shifting profile and has an engaging position mad a non-engaging position. The bore diameter of the honed bore is configured to deploy the shifter key to the engaging position. More preferably, however, a covering sleeve is also present. The covering sleeve is configured to slidably cover the shifter key as the shifter is run into the wellbore. The covering sleeve has dogs associated with it that are engageable with the honed bore to slide the covering sleeve to a non-covering position, to thereby allow the shifter key to deploy to the engaging position.

In another embodiment of the present invention, there is provided a subterranean structure for controlling tool access to a lateral wellbore extending from a wellbore that comprises a bushing, a slidable access control device, a shifting sleeve, and a shifter. The bushing is located in the wellbore and proximate an opening to the lateral wellbore and has an access window therethrough for allowing access by a tool to the lateral wellbore through the opening. The slidable access control device is coaxially coupled to the bushing, and the shifting sleeve is coupled to the slidable access control device and has a shifting profile associated with it. The shifting sleeve is positioned along a longitudinal axis of the wellbore for reciprocal movement with respect thereto to rotate the slidable access control device about a longitudinal axis of the bushing. The shifter is engageable with the shifting profile of the shifting sleeve to cause the slidable access control device to rotate between an open position wherein a tool is allowed to pass through the window and the opening and into the lateral wellbore and a closed position wherein the tool is prevented from passing through the window and the opening and into the lateral wellbore.

Preferably, the subterranean structure further comprises a follower extending through cams associated with the shifting sleeve and the slidable access control device. The cams are positioned relative to one another and are configured to allow the follower to concurrently move through the cams to thereby slide the slidable access control device by rotating the slidable access control device about a longitudinal axis of the bushing between the open and closed positions as the shifting sleeve is slid along the longitudinal axis of the wellbore. Preferably, the follower causes the slidable access control device to rotate about 120° with respect to the longitudinal axis of the bushing.

In a preferred embodiment, the follower is a camming lug coupling a first cam associated with the shifting sleeve and a second cam associated with the slidable access control device. The camming lug extends through the first and second cams, and the first and second cams are offset at a predetermined angle with respect to one another to impart a rotational component to the slidable access control device. The first cam is preferably a slot formed in and along a longitudinal axis of the shifting sleeve and the second cam is preferably a helical slot formed in and around a longitudinal axis of the slidable access control device.

In one aspect of this particular embodiment, the shifter includes a shifting profile configured to engage the shifting profile of the shifting sleeve to rotate the slidable access control device between the open and closed positions. The shifting sleeve may include an opening shifting profile configured to engage the shifting profile of the shifter, to thereby rotate the slidable access control device from the closed position to the open position, or it may include a closing shifting profile configured to engage the shifting profile of the shifter, to thereby rotate the slidable access control device from the opened position to the closed position. In a preferred embodiment, both the opening and closing shifting profiles are present.

The foregoing has outlined rather broadly the features and technical advantages of the present invention so that those skilled in the art may better understand the detailed description of the invention that follows. Additional features and advantages of the invention will be described hereinafter that form the subject of the claims of the invention. Those skilled in the art should appreciate that they may readily use the conception and the specific embodiment disclosed as a basis for modifying or designing other structures for carrying out the same purposes of the present invention. Those skilled in the art should also realize that such equivalent constructions do not depart from the spirit and scope of the invention in its broadest form.

BRIEF DESCRIPTION OF THE DRAWINGS

For a more complete understanding of the present invention, and the advantages thereof, reference is now made to the following descriptions taken in conjunction with the accompanying drawings, in which:

FIG. 7A illustrates the uphole portion of a vertically foreshortened, partial cross-sectional view of an alternate embodiment of the slidable access control device of the present invention;

FIG. 7B illustrates an top cross-sectional view of FIG. 7A taken along the line 7B—7B showing the bushing window in the open position and the slidable access control device;

FIG. 7C illustrates the downhole portion of a vertically foreshortened, partial cross-sectional view of the slidable access control device of FIG. 7A with the shifter about to disengage the opening shifting profile of the shifting sleeve after rotating the slidable access control device to an open position;

FIG. 7D illustrates a top cross-sectional view of FIG. 7C taken along the line 7D—7D showing the alignment of the follower and the cams when the slidable access control device is in an open position;

FIG. 7E illustrates a schematic representation of the position of the camming lug extending through the slot formed in the shifting sleeve and the helical slot formed in the slidable access control device after the slidable access control device has been moved to the open position;

DETAILED DESCRIPTION

Figure 1:
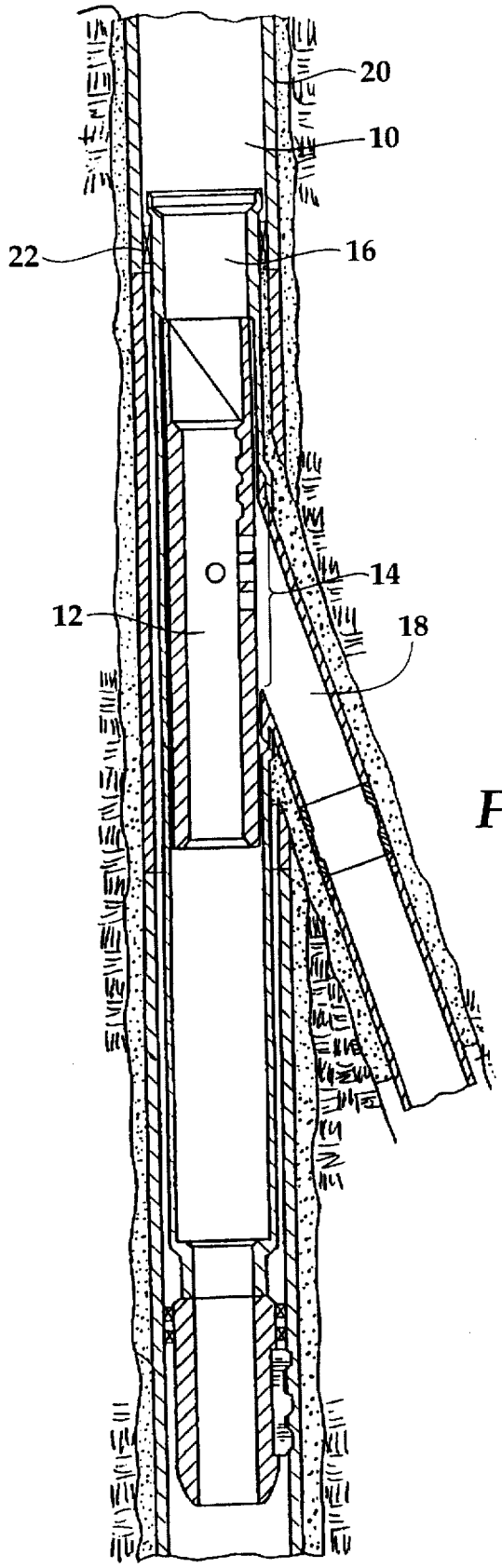
FIG. 1 illustrates a vertically foreshortened, highly schematic partial cross-sectional view of the wellbore with a bushing having an access window therein proximate the lateral wellbore and a slidable access control device proximate the bushing window.

Turning initially to FIG. 1, there is illustrated a vertically foreshortened, highly schematic partial cross-sectional view of a wellbore 10 with a slidable access control device 12 proximate an access window 14 of a bushing 16 positioned proximate a lateral wellbore 18. In this particular embodiment, casing 20 has been cemented into place within the wellbore 10, and the bushing 16 has been set in place with lining hangers 22 such that the window 14 is proximate the lateral wellbore 18 to allow entry into the lateral wellbore 18 from the wellbore 10. While the illustrations discussed herein show applications directed to a wellbore lined with casing, it should be understood that the present invention may also be used in a wellbore that is not lined with casing, i.e., an open wellbore.

The slidable access control device 12 is rotated about or shifted along a longitudinally axis of the wellbore 10 in a manner that is described below. In FIG. 1, the slidable access control device 12 is shown in the closed position wherein the window 14 is covered to prevent entry of a tool into the lateral wellbore 18. The types of tool that are used in the present application vary greatly depending on the operation. For instance, the tool may be any type of completion tool or device, production tool or device, work-over tool or device or plugging tool or device that can be used in the completion, production, work-over or plugging of a well. In its upper portion, the slidable access control device 12 may have fluid ports 24 that can be aligned with fluid ports **16*a* formed in the bushing 16 to allow fluid communication between an interior of the bushing 16 and the annulus 10*a* of the wellbore, but neither of which are of a size sufficient to allow tool reentry into the lateral wellbore 18. The fluid ports 24 and 16*a* may be aligned by sliding the slidable access control device 12 within the bushing 18 such that the fluid ports 24 and 16*a* are aligned to establish fluid communication between the interior of the bushing 16 and the annulus 10*a***.

When the slidable well control device 12 is moved by rotating about or sliding along a longitudinal axis to an open position, as described below, tool reentry into the lateral wellbore 18 is allowed. As used herein the term "open" means that the window 14 is open to a degree sufficient to allow a tool to enter the lateral wellbore 18 from the wellbore 10. Since the slidable access control device 12 has a hollow core, access to the lower portions of the wellbore 10 may be achieved by using tools having a diameter smaller than that of the hollow core. It will, of course, be appreciated that while only one slidable access control device is shown, a plurality of such devices could be used in those instances where a plurality of lateral wellbores extend from a wellbore. Alternatively, a single slidable access control device 12 may be used to control access to a plurality of lateral wellbores 18.

Figure 2A:
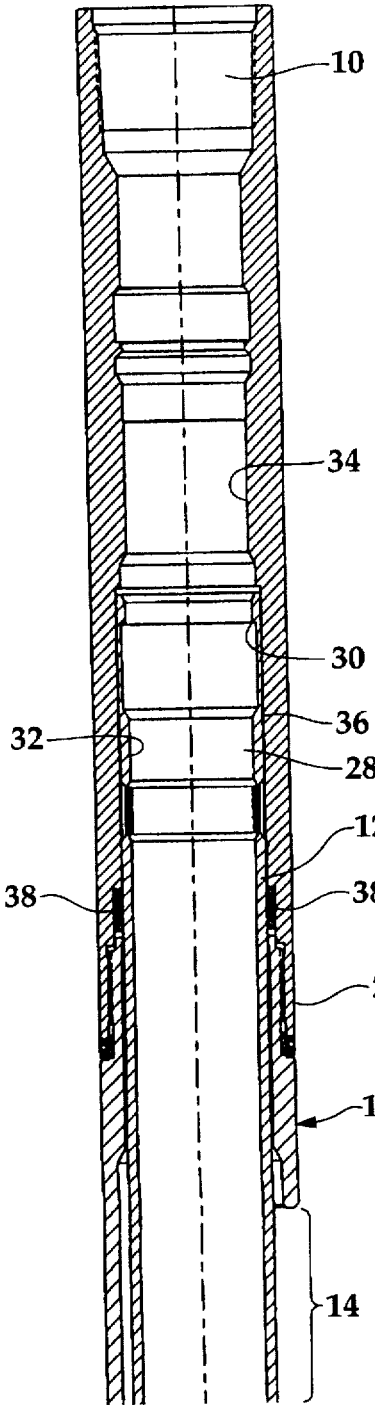
FIG. 2A illustrates the uphole portion of a vertically foreshortened, partial cross-sectional view of the bushing window with the slidable access control device in a closed position and covering the window.

Turning now to FIG. 2A, there is illustrated a vertically foreshortened, partial cross-sectional view of an uphole (i.e., toward the surface of the well) portion 26 of the bushing 16 with the slidable access control device 12 in a closed position mad covering the window 14. As used herein, the term "closed" means that the window is sufficiently closed to prevent the entry of a tool into the lateral wellbore 18 from the wellbore 10, which does not require the window to be completely closed. As illustrated, the bushing 16 and the slidable access control device 12 are coaxial with each other and extend longitudinally along wellbore 10 with the slidable access control device 12 slidably positioned with the bushing 16. An uphole portion 28 of the slidable access control device 12 with a shifting profile 30 associated therewith is also shown. In a preferred embodiment, the shifting profile 30 is integrally formed within the interior wall 32 of the slidable flow control device 12 and is positioned at the uphole end 28 of the device such that a shifter can engage the shifting profile 30 and slide the slidable access control device 12 to the desired position. As illustrated, the shifting profile 30 is a closing profile that is used to slide the slidable access control device 12 to a closed position. In this particular embodiment, the slidable access control device 12 is moved along the longitudinal axis of the wellbore 10 in an uphole, downhole (i.e., toward the bottom of the well) fashion to achieve the closed and open positions.

Positioned between an inner wall 34 of the bushing 16 and an outer wall 36 of the slidable access control device 12 is a seal 38 that forms a seal between the bushing's inner wall 34 and the outer wall 36 of the slidable access control device 12. Preferably, the seal 38 forms a pressure tight seal that prevents fluids from flowing between the wellbore 10 and the lateral wellbore 18 (FIG. 1). While the seal 38 is shown to be positioned within the bushing's inner wall 34, it will, of course, be appreciated that the seal 38 may also be formed within the outer wall 36 of the slidable access control device 12. Depending on which device in which the seal 38 is placed, the seal 38 is designed to disengage from either the bushing 16 or the slidable access control device 12 when the slidable access control device 12 is moved to an open position and re-engage when the slidable access control device 12 is moved to the closed position.

Figure 2B:
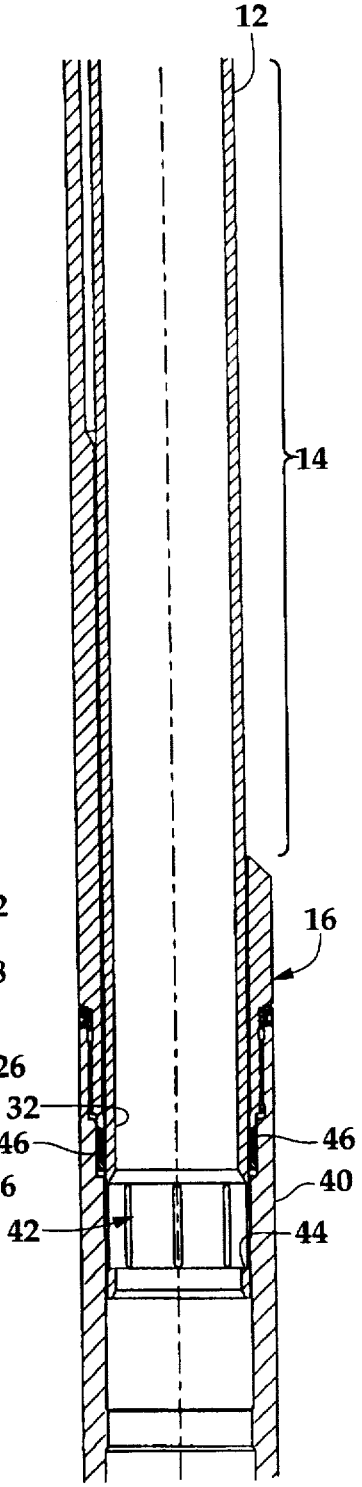
FIG. 2B illustrates the downhole portion of the vertically foreshortened, partial cross-sectional view of the bushing window of FIG. 2A with the slidable access control device in a closed position and covering the window.

Turning now to FIG. 2B, there is illustrated a vertically foreshortened, partial cross-sectional view of a downhole portion 40 of the bushing 16 with the slidable access control device 12 in a closed position and covering the window 14. A downhole portion 42 of the slidable access control device also preferably includes a shifting profile 44 associated therewith. In a preferred embodiment, the shifting profile 44 is an opening shifting profile that is integrally formed within the interior wall 32 of the slidable flow control device 12 and is positioned at the downhole end 42 of the device such that a shifter can engage the shifting profile 44 and slide the slidable access control device 12 to an open position.

Positioned between the inner wall 34 of the bushing 16 and the outer wall 36 of the slidable access control device 12 is a second seal 46 that forms a seal between the bushing's inner wall 34 and the outer wall 36. Preferably, this second seal 46 cooperates with the first seal 38 (FIG. 2A) to form a pressure tight seal that prevents fluids from flowing between the wellbore 10 and the lateral wellbore 18 (FIG. 1). While the seal 46 is shown to be positioned within the bushing's inner wall 34, it will, of course, be appreciated that the seal 46 may also be formed within the outer wall 36 of the slidable access control device 12. Unlike the seal 38 discussed above in FIG. 2A, this second seal 46 is not intended to disengage from the bushing 16 or the slidable access control device 12 in a preferred embodiment. However, there are those embodiments where the seal 46 may be designed to disengage.

Figure 2C:
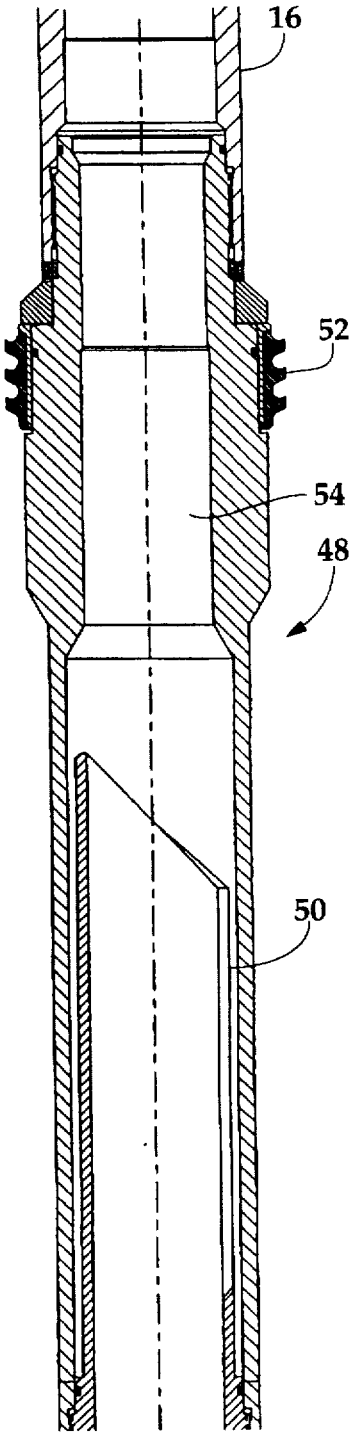
FIG. 2C illustrates a vertically foreshortened, partial cross-sectional view of the downhole substructure to which the bushing is coupled.

Referring now briefly to FIG. 2C, them is illustrated a vertically foreshortened, partial cross-sectional view of a downhole substructure 48 to which the bushing 16 is coupled. The substructure 48 includes an orienting and locking profile 50 that is coupled to the bushing 16. The purpose of the orienting and locking profile 50 is to properly orient and lock a diverter in place so that tools may be diverted into the lateral wellbore 18 (FIG. 1) when the window 14 is in the open position. Preferably, the orienting and locking profile 50 is a nipple muleshoe that has a orienting and locking profile formed therein to orient and lock a diverter as discussed below. The substructure 48 further includes debris seals 52 that prevent debris from falling downhole. The substructure further comprises a honed bore 54 that has an inside diameter smaller than the inside diameter of the bushing 16.

Figure 3A:
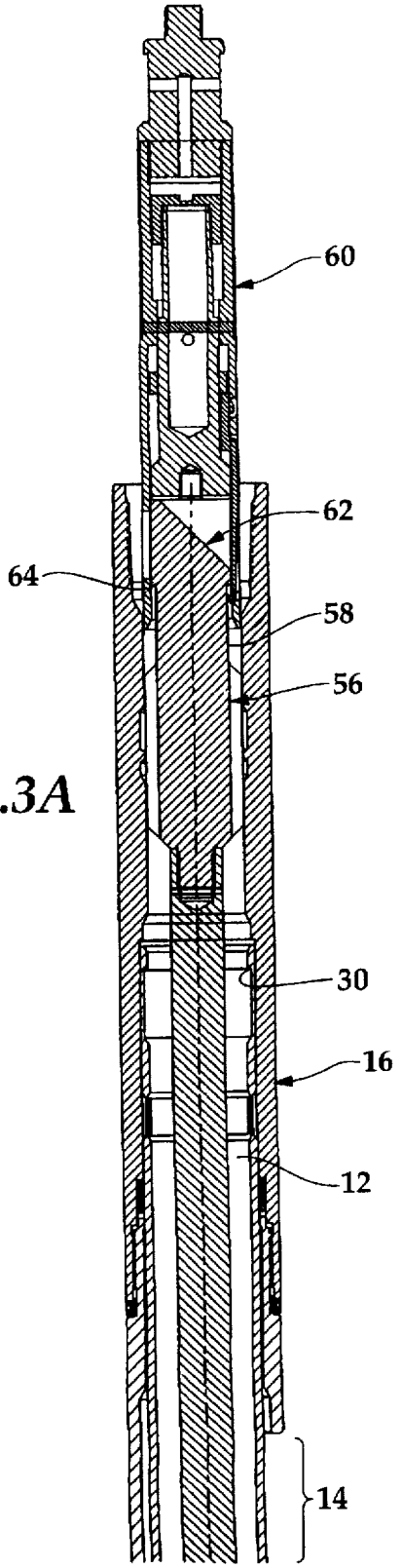
FIG. 3A illustrates the uphole portion of a vertically foreshortened, partial cross-sectional view of the deflector coupled to an actuator and being positioned within the wellbore.

Turning now to FIG. 3A, there is illustrated an embodiment of the subterranean structure that includes a deflector 56. As shown, FIG. 3A illustrates a vertically foreshortened, partial cross-sectional view of an uphole portion 58 of the deflector 56 coupled to an actuator 60 and positionable within the wellbore 10. The uphole portion 58 is conventional in design and includes a diverting head 62 for diverting tools into a lateral wellbore from a wellbore. The diverting head 62 has a shoulder 64 formed thereon that allows the actuator 60, such as a running tool, pulling tool or wireline to be releasably attached to the deflector 56 so that it can be positioned within the wellbore 10. The actuator 60 is of conventional design and preferably includes dogs 66 that are configured to releasably engage the shoulder 64 of the diverting head 62. The deflector 56 has an overall diameter that permits it to be lowered through the bushing 16 by the actuator 60. As shown, the downhole portion of the deflector 56 has passed by and has not engaged the closing shifting profile 30 of the slidable access control device for reasons discussed below.

Figure 3B:
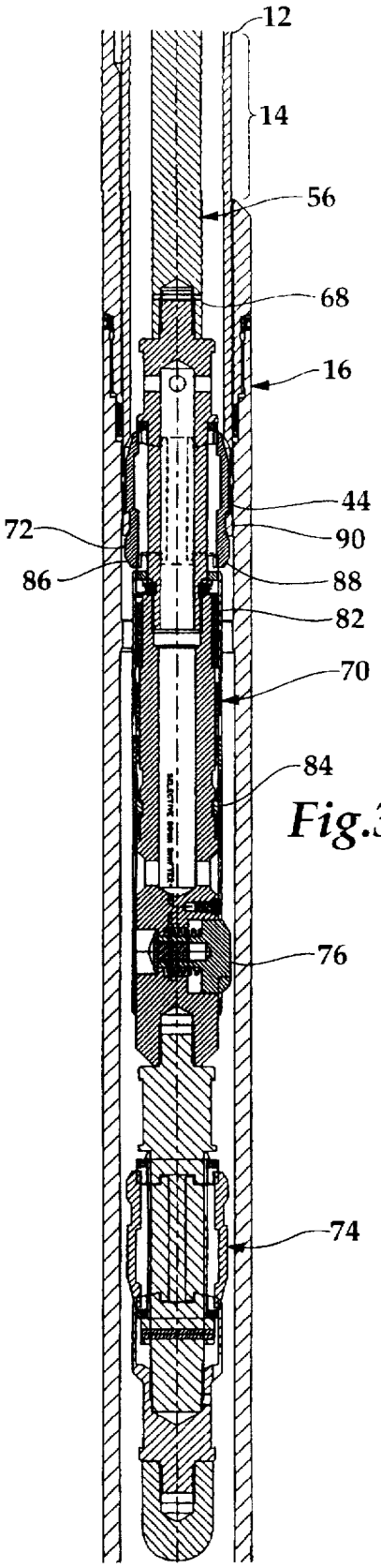
FIG. 3B illustrates the downhole portion of a vertically foreshortened, partial cross-sectional view of the deflector with the shifter coupled thereto and engaged with an opening shifting profile of the downhole portion of the bushing.

Referring now to FIG. 3B, there is illustrated a downhole portion 68 of the deflector 56 with a shifter 70 coupled thereto and engaged with the opening shifting profile 44 of the downhole portion 42 of the slidable access control device 12. It should be understood that while the shifter 70 is shown coupled to the deflector 56, the deflector 56 is not essential to the operation of the present invention since the shifter 70 could be run in on a wireline if so desired. The shifter 70 is preferably comprised of an upper shifting profile 72 that is configured to engage the opening shifting profile 44 of the slidable access control device 12 and a lower shifting profile 74 that is configured to engage the closing shifting profile 30 of the slidable access control device 12 (FIG. 3A). While the preferred embodiment of the shifter 70 is described herein, it should be understood that the shifter 70 may be various types of system that are associated with the slidable access control device 12. For example, the shifter 70 may be a hydraulic system that is either coupled to or integrally formed with the slidable access control device 12. The hydraulic system may include a hydraulic actuated piston that directly engages the slidable access control device 12 to move it between the open and closed positions. Alternatively, the hydraulic system may include a system of sealed chambers associated witch the slidable access control device 12 such that the hydraulic fluid moves the slidable access control device 12 when pressured is exerted against the hydraulic fluid. In yet another embodiment, the shifter 70 may be an electromechanical, electrical or electromagnetic device or system that is either directly or indirectly coupled to the slidable access control device 12 to move it between the open and closed positions.

In a preferred embodiment, the deflector 56 includes an orienting lock 76, which preferably is a spring biased lug lock of conventional design, that is positioned between the upper and lower shifting profiles 72,74 to orient and lock the deflector 56 in a correct diverting position with the lateral wellbore. In such instances, the substructure 48 preferably includes the orienting and locking profile 50 (FIGS. 3C and 3D) coupled to the downhole end 40 of the bushing 16. The orienting and locking profile 50 is preferably formed in a conventional nipple muleshoe 78. The orienting and locking profile 50 is preceded by an expansion gap 80 that allows the nipple muleshoe 78 to act like a large snap ring. The expansion gap 80 expands as the orienting lock 76 traverses the orienting and locking profile 50 and then restricts when the orienting lock 76 engages the orienting and locking profile 50. When the orienting lock 76 is engaged, the deflector 56 is positioned in a correct diverting position with the lateral wellbore 18 (FIG. 1 ).

Figure 3C:
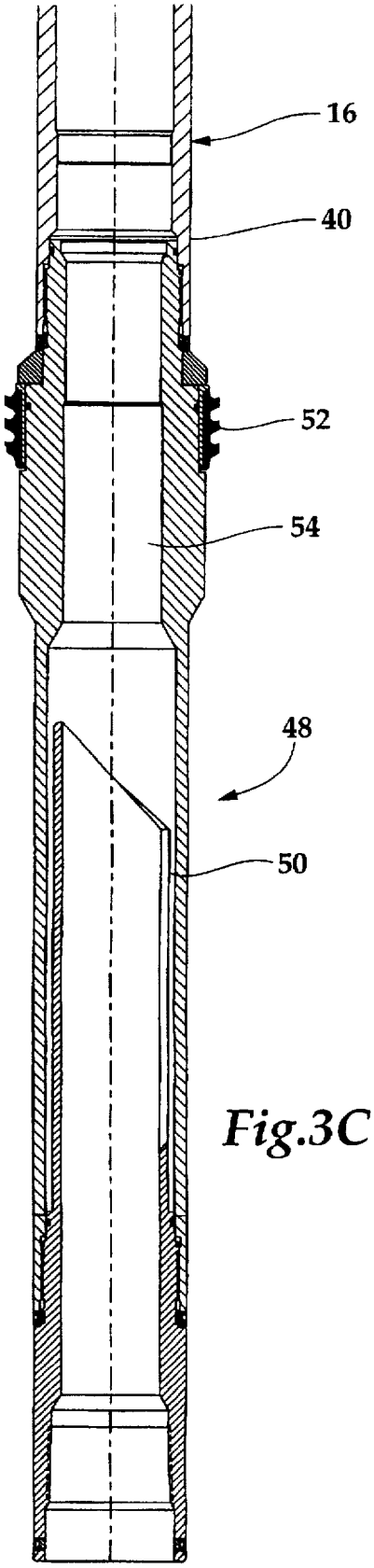
FIG. 3C illustrates the downhole portion of a vertically foreshortened, partial cross-sectional view of the substructure to which the bushing is coupled.
Figure 3D:
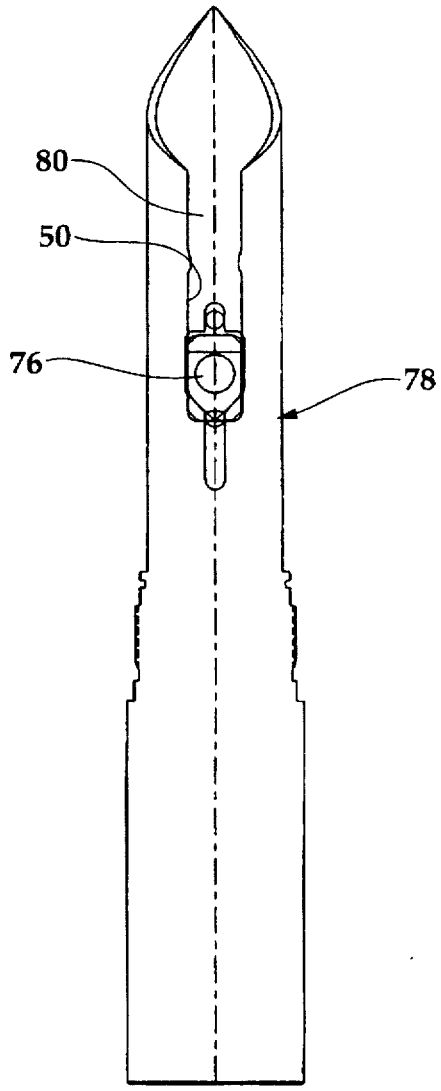
FIG. 3D illustrates a perspective view of substructure of FIG. 3C that includes the orienting and locking profile with the orienting lock engaged therein.

Continuing to refer to FIG. 3B, the upper shifting profile 72 preferably includes a spring biased covering sleeve 82 of conventional design that protects and covers the upper shifting profile 72 as the shifter 70 is being lowered into the wellbore 10. Additionally and more importantly, the covering sleeve 82 prevents the upper shifting profile 72 from engaging the opening shifting profile 44 of the slidable access control device 12 until the shifter 70 is moved to the proper position. The covering sleeve 82 has resilient dogs 84 associated therewith that extend radially outward from the shifter 70 and that flex inwardly when the shifter 70 is passed downhole through a diameter less than that of the outer diameter of the dogs 84, such as a honed bore 54 (FIG. 3C). However, when the shifter 70 is pulled uphole, the: dogs 84 engage the inner diameter of the honed bore 54 (FIG. 3C), which causes the closing sleeve 82 to be pulled downhole and off of the upper shifting profile 44, which is preferably a spring biased "B"-type key shifter. When the covering sleeve 82 is removed, the spring biases the key 86 outwardly and allows it to engage the opening shifting profile 44 of the slidable access control device 12. The upper shifting profile 72 also includes a releasing shoulder 88 that is engagable with a camming shoulder 90 on the slidable access control device's opening shifting profile 44. After the slidable access control device 12 has been moved to the open position, the slidable access control device 12 contacts the honed bore 54. Since the outer diameter of the slidable access control device 12 is larger than the inner diameter of the honed bore 54, the slidable access control device 12 is prevented from moving further downhole. As continued downward force is exerted on the shifter 70, the releasing shoulder 88 engages the camming shoulder 90. The camming shoulder 90 forces the downhole end of the upper shifting profile 72 inwardly, which causes it to disengage and release from the opening shifting profile 44 and allows the shifter 70 to move downhole from the slidable access control device 12.

The lower shifting profile 74 is preferably a key shifter that has a profile that is configured to engage only the closing shifting profile 30 (FIG. 3A) of the slidable access control device 12. As such, it does not engage the opening shifting profile 44 when the shifter 70 is moved downhole, and thus does not require a cover sleeve.

Figure 4A:
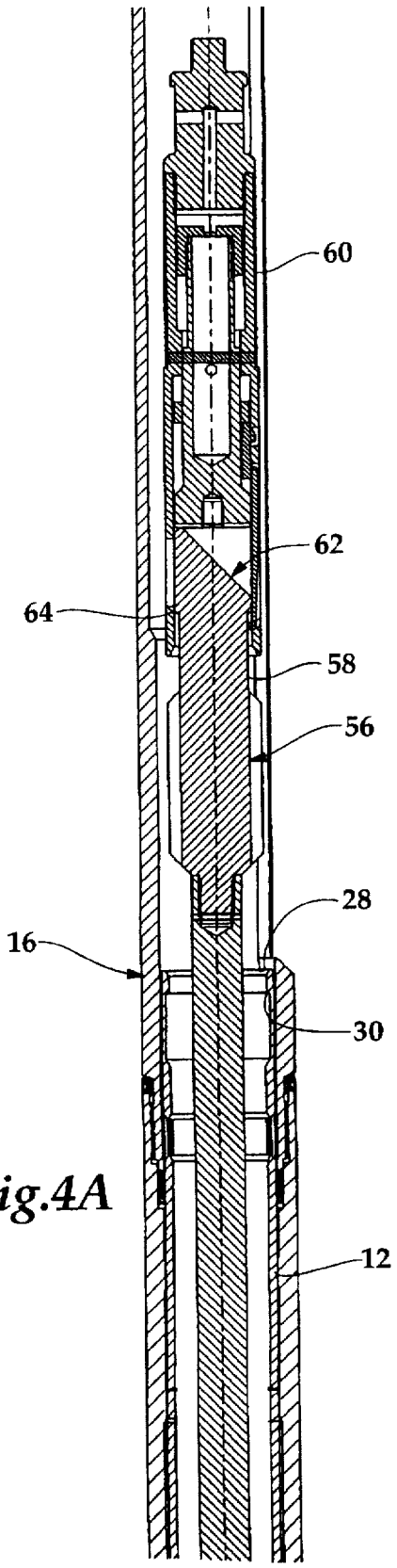
FIG. 4A illustrates the uphole portion of a vertically foreshortened, partial cross-sectional view of the deflector of FIG. 3A after the shifter has engaged the slidable access control device, and it has been moved to the open position.

Turning now to FIG. 4A, there is illustrated the uphole portion of a vertically foreshortened, partial cross-sectional view of the deflector 56 coupled to the actuator 60 after engaging the slidable access control device 12 and sliding it to the open position. As shown, the uphole end 28 of the slidable access control device 12 has disengaged from the upper seals 38 (FIG. 2A). Once the deflector 56 is positioned, the actuator 60 is released from the deflector 56 by conventional means.

Figure 4B:
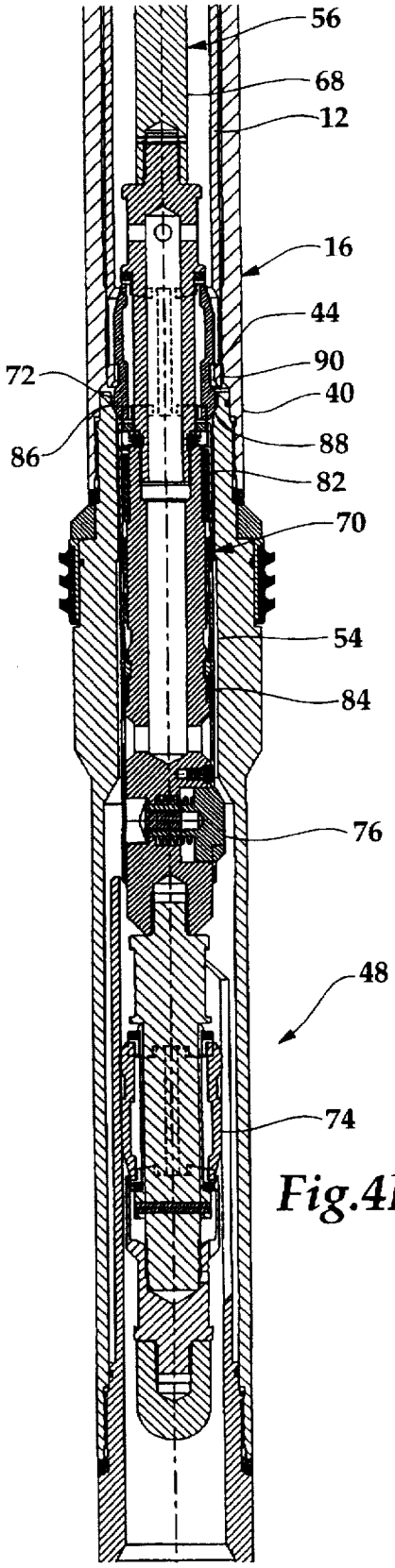
FIG. 4B illustrates the downhole portion of a vertically foreshortened, partial cross-sectional view of the deflector of FIG. 4B disengaging from the opening profile of the slidable access control device.

Turning now to FIG. 4B, there is illustrated a vertically foreshortened, partial cross-sectional view of the downhole portion 68 of the deflector 56 of FIG. 4A disengaging from the opening shifting profile 44 of the slidable access control device 12. As previously explained, the releasing shoulder 88 of the upper shifting profile 72 engages the camming shoulder 90 of the opening shifting profile 44 and causes the shifter 70 to be released from the slidable access control device 12.

Figure 5A:
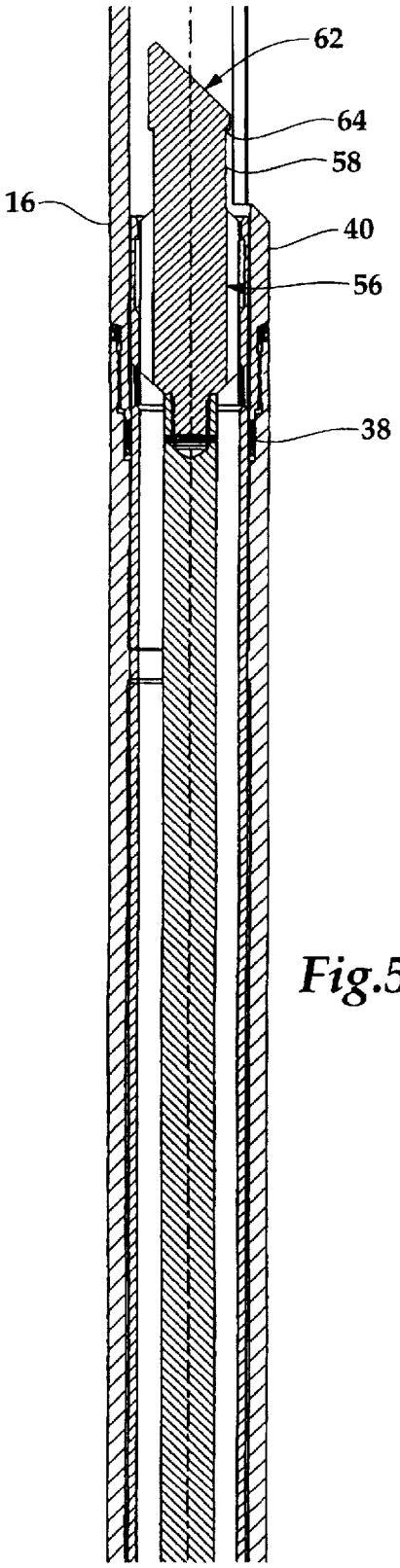
FIG. 5A illustrates the uphole portion of a vertically foreshortened, partial cross-sectional view of the deflector of FIG. 4A in an oriented and locked position proximate the bushing window after the shifter has engaged the slidable access control device, and it has been moved to the open position.
Figure 5B:
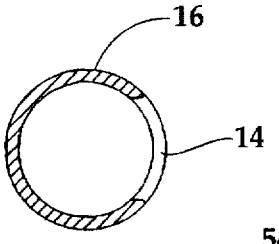
FIG. 5B illustrates an top cross-sectional view of the bushing window in the open position.
Figure 5C:
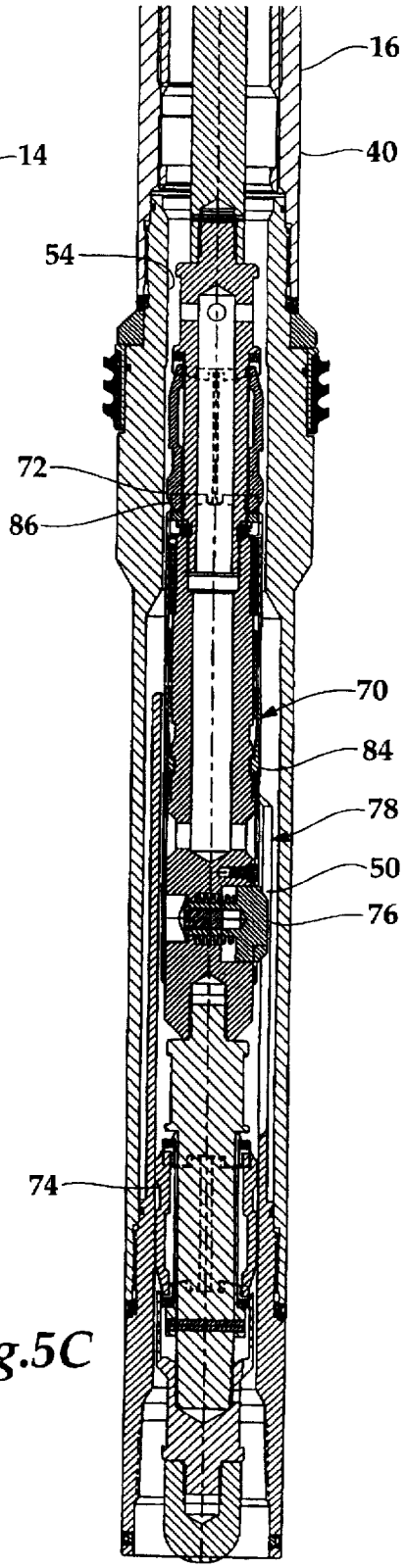
FIG. 5C illustrates the downhole portion of a vertically foreshortened, partial cross-sectional view of the deflector of FIG. 5A with the orienting lock engaged in the oriented and locked position within the orienting and locking profile of FIG. 3D that is coupled to the bushing.

Turning now briefly to FIGS. 5A, 5B and 5C, there is illustrated the deflector 56 of FIG. 4A and 4B shown in the disengaged position and in the oriented mad locked position. As shown, the slidable access control device 12 has been moved downhole along the longitudinal axis of the bushing 16, thereby opening the window 14 as illustrated in FIG. 5B. The downward motion of the slidable access control device 12 is stopped by the smaller diameter of the honed bore 54. The upper shifting profile 72 of the shifter 70 is disengaged from the opening shifting profile 44 of the slidable access control device 12, and the orienting lock 76 is engaged in the orienting and locking profile 50 formed within the nipple muleshoe 78.

Figure 6:
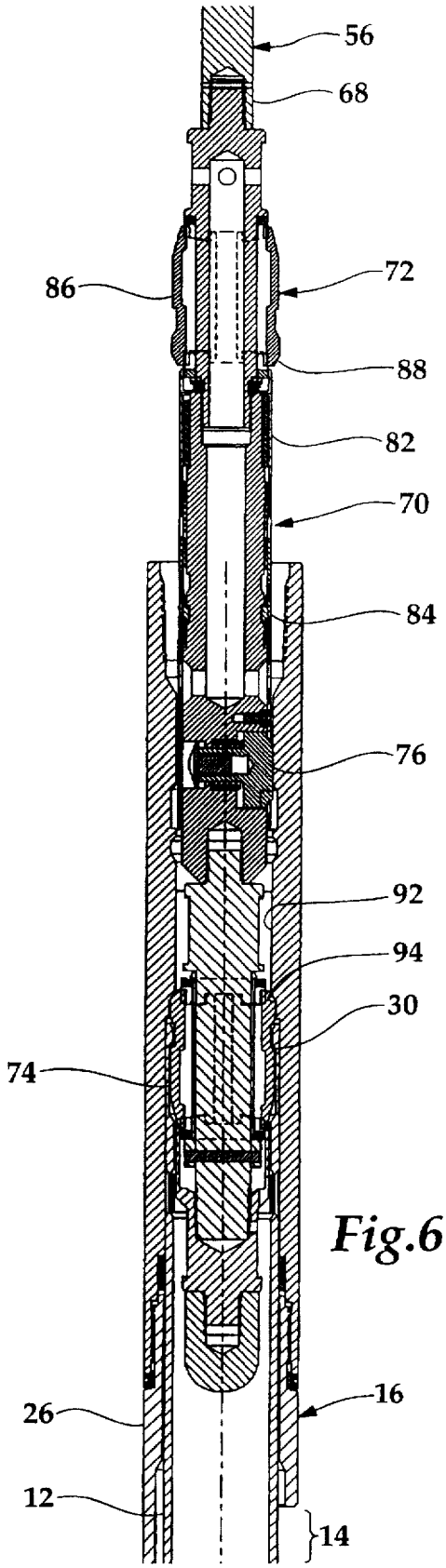
FIG. 6 illustrates the uphole portion of a vertically foreshortened, partial cross-sectional view of the deflector after the shifter has engaged the closing profile of the slidable access control device, and it has been moved to the closing position.

Referring now to FIG. 6, the shifter 70 engaged with the closing shifting profile 30 of the slidable access control device 12 is illustrated. In this view, the deflector 56 to which the shifter 70 is coupled has been pulled uphole from the window 14 and along the longitudinal axis of the wellbore 10. The lower shifting profile 74 is engaged in the closing shifting profile 30, and the slidable access control device 12 is shown in the closed position. The uphole movement of the slidable access control device 12 is stopped by an upper honed bore 92 where a releasing shoulder of the lower shifting profile 74 engages a camming shoulder 96 of the closing shifting profile 30 to thereby release the shifter 70 from the slidable access control device 12 in the same mariner as previously described for the shifter's upper shifting profile 72 (FIG. 4B). When in the closed position, the slidable access control device 12 is conventionally held in place by collets engaged in detents formed in the interior wall of the bushing 16.

With the foregoing embodiment having been described, a preferred method of its operation will now be discussed with general reference to FIGS. 1 through 6. Upon completion of a wellbore 10 and a lateral wellbore extending therefrom in the manner described in U.S. Pat. No. 5,564,503, the bushing's window 14 will typically be in the closed position. In such instances, it may be desired to open the window 14 and set a deflector 56 in one trip. The single trip is desirable because of the savings in time and money. Moreover, the deflector 56 can serve as the device with which to actuate the shifter 70. The shifter 70 is coupled to the dowmhole end 68 of the deflector 56, and the deflector 56 is preferably run into the wellbore 10 with a running/pulling tool. As the shifter 70 is being run into the wellbore 10, the covering sleeve 82 covers the upper shifting profile 72 of the shifter 70 to prevent it from inadvertently prematurely engaging the opening shifting profile 44 of the slidable access control device 12.

The shifter 70 is passed through the honed bore 54 which is downhole from the window 14. The deflector 56 is then picked back up, and the dogs 84 associated with the covering sleeve 82 engage the inner walls of the honed bore 54, thereby causing the covering sleeve 82 to slide off of the upper shifting profile 72. The keys 86 of the upper shifting profile 72 are then biased outwardly by spring members. As the deflector 56 mad shifter 70 are pulled uphole, the upper shifting profile 72 engages the opening shifting profile of the slidable access control device 12. Once engaged, the deflector 56 and shifter 70 are then bumped downhole, thereby pulling the slidable access control device 12 downhole along the longitudinal axis of the wellbore 10. The slidable access control device 12 is moved downhole until its downhole end 42 engages the honed bore 54.

As the deflector 56 and the shifter 70 continue to be moved downhole, the releasing shoulder 88 of the upper shifting profile 72 engages the camming shoulder 90 of the opening shifting profile 44 of the slidable access control device 12. The downhole end of the upper shifting profile 72 is forced inwardly toward the shifter 70, which releases the shifter 70 from the slidable access control device 12.

The deflector 56 and shifter 70 are moved down further until the orienting lock 76 engages the orienting and locking profile 50 in the nipple muleshoe 78. When so engaged, the deflector 56 is properly oriented to the lateral wellbore for diverting tools into the lateral wellbore 18. After the deflector 56 is set, the actuator 60 is disengaged from the diverting head 62 of the deflector 56 and removed from the wellbore 10.

When diverting operations are completed, the actuator 60 is re-engaged with the diverting head 62. Sufficient lifting force is applied to the deflector 56 to disengage the orienting lock 76, thereby releasing the deflector 56 and shifter 70. The shifter 70 is then pulled uphole until the lower shifting profile 74 engages the closing shifting profile 30 of the slidable access control device 12. The slidable access control device 12 is then moved uphole along the longitudinal axis of the wellbore 10 until the upper honed bore 92 is engaged by the uphole end 28 of the slidable access control device 12. The releasing shoulder 94 of the lower shifting profile 74 engages the camming shoulder 96 of the closing shifting profile 30 and releases the deflector 56 and shifter 70 in the same manner as previously described for the upper shifting profile 72. The slidable access control device 12 is then conventionally held in the closed position by collets.

A preferred alternate embodiment of the present invention is illustrated in FIGS. 7A–8D and will now be discussed. In FIG. 7A there is illustrated the uphole end 26 of the bushing 16 having the window 14 formed therein with the window 14 shown opened. Preferably, the bushing 16 is partially encompassed by the slidable access control device 12 that rotates about a longitudinal axis of the wellbore 10. A top cross-sectional view is shown in FIG. 7B illustrating the position of the slidable access control device 12 when in the open position.

Turning now to FIG. 7C, a shifter 98 is shown positioned in the wellbore 10 preferably by a wireline (not shown). The shifter 98 is of conventional design and is comprised of a body member 100 with shifting profiles 102 that are preferably spring biased key members. The shifter 98 preferably includes a shifting sleeve 104 that has an opening shifting profile 106 positioned near a downhole end 108 of the shifting sleeve 104 and a closing shifting profile 110 positioned near an uphole end 112 of the shifting sleeve 104. The opening and closing shifting profiles 106,110 are configured to engage the shifting profiles 102 of the shifter 98. In FIG. 7C, the shifting profile 102 is engaged with the closing profile 110 of the shifting sleeve 104. The shifting profiles 102 further include a releasing shoulder 114 that engages a camming shoulder 116 of the opening shifting profile 106. The camming shoulder 116 forces the spring biased shifting profile 102 inwardly, thereby causing the shifter 98 to release from the slidable access control device 12.

The shifting sleeve 104 and the slidable access control device 12 preferably have cams 118, 120, respectively, formed therein that translate a longitudinal movement of the shifting sleeve 104 along the wellbore 10 into a rotational movement of the slidable access control device 12 about the longitudinal axis of the wellbore 10. The cams 118, 120 preferably comprise a first cam path **118*a* associated with the slidable access control device 12 and a second cam 120*a* associated with shifting sleeve 104. More preferably, the first cam 118*a* is helical slot that extends around the slidable access control device 12 and the second cam 120*a* is substantially straight slot that extends along the longitudinal axis of the wellbore 10. The first and second cams 118*a*, 120*a* are coupled by a follower 122 that is preferably a camming lug that extends through the first and second cams 118*a*, 120*a*, as shown in FIG. 7D. The relative position of the follower 122 to the first and second cams 118*a*, 120*a* when the slidable access control device 12 is in the opened position is shown in FIG. 7E**.

Figure 8A:
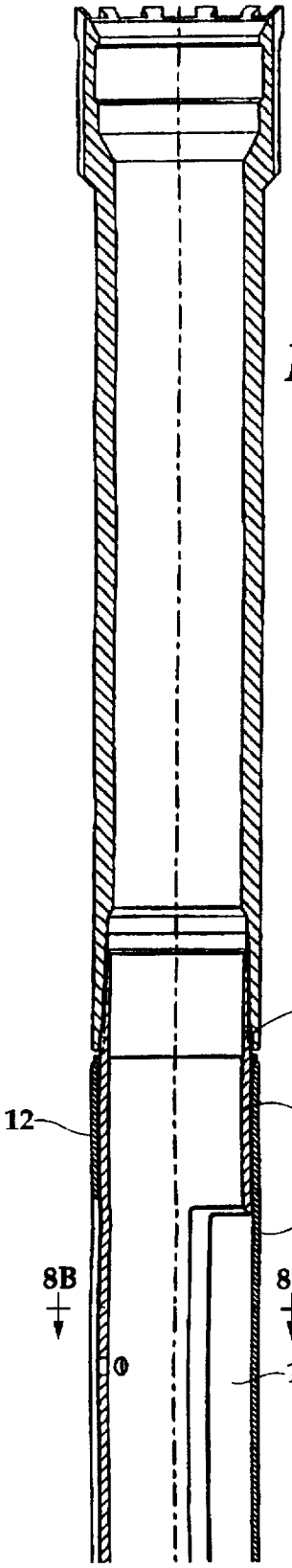
FIG. 8A illustrates the uphole portion of a vertically foreshortened, partial cross-sectional view of the bushing with the slidable access control device rotated to a closed position.
Figure 8B:
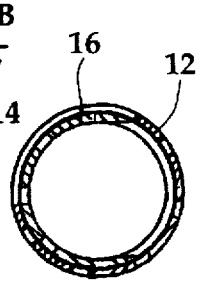
FIG. 8B illustrates a top cross-sectional view of FIG. 8A taken along the line 8B—8B showing the slidable access control device rotated to a closed position.

In FIG. 8A there is illustrated the uphole end 26 of the bushing 16 with the window 14 shown closed. A top cross-sectional view is shown in FIG. 8B illustrating the position of the slidable access control device 12 when it is in the closed position.

Figure 8C:
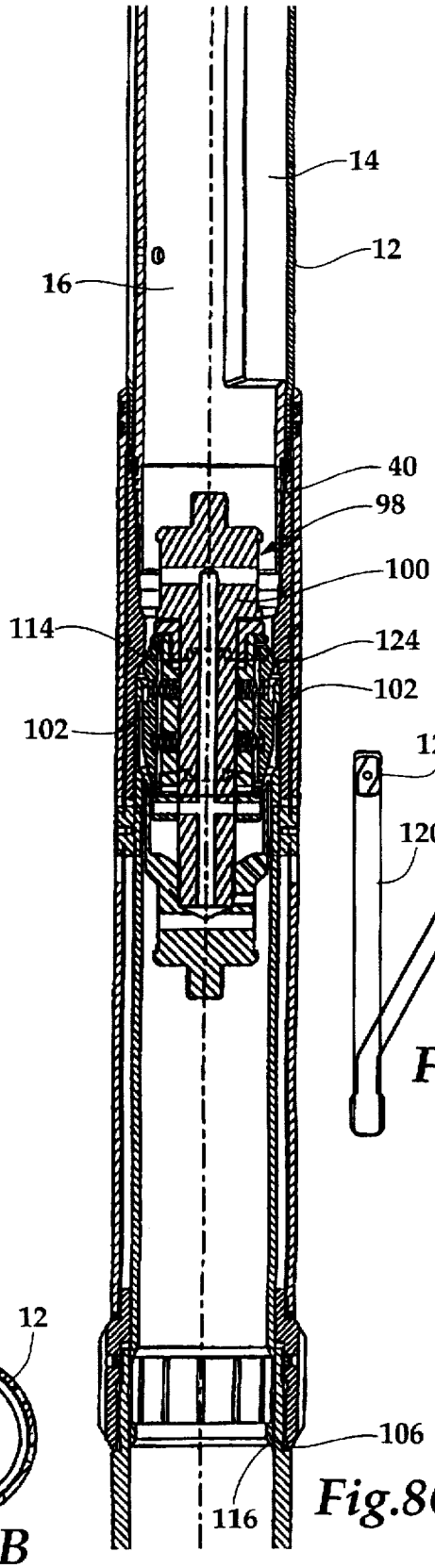
FIG. 8C illustrates the downhole portion of a vertically foreshortened, partial cross-sectional view of the slidable access control device with the shifter about to disengage the closing shifting profile of the shifting sleeve after rotating the slidable access control device to a closed position.
Figure 8D:
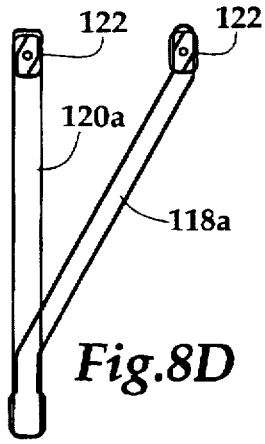
FIG. 8D illustrates a schematic representation of the position of the camming lug extending through the slot formed in the shifting sleeve and the helical slot formed in the slidable access control device after the slidable access control device has been rotated to a closed position.

Turning now to FIG. 8C, the shifter 98 is shown positioned in the wellbore 10 preferably by a wireline (not shown). In a preferred embodiment, this shifter 98 is the same one used to open the window 14 with the exception that the shifter 98 has been inverted to re-orient the shifting profile 102 to engage the closing shifting profile 110 for closing the window 14. However, it will, of course, be appreciated that a different shifter with the appropriate shifting profile could be used if so desired. As shown in FIG. 8C, the shifting profile 102 is oriented to engage the closing shifting profile 110 positioned near the uphole end 112 of the shifting sleeve 104. The shifting profile 102, of course includes the releasing shoulder 114 that engages a camming shoulder 124 of the closing shifting profile 110. The camming shoulder 124 forces the spring biased shifting profile 102 inwardly, thereby causing the shifter 98 to release from the slidable access control device 12. The relative position of the follower 122 to the first and second cams **118*a*, 120*a* when the slidable access control device 12 is in the closed position is shown in FIG. 8D**.

With an alternate embodiment of the present invention having been described, a preferred method of its operation will now be discussed with general reference to FIGS. 7A–8D. When the window 14 is in the closed position and further operations require that the window be opened, the shifter 98 is run into the wellbore 10 on a wireline. In those instance where the shifter 98 is reversible as discussed above, it is imperative that the shifter 98 be oriented so that the shifting profile 102 will engage the opening shifting profile 106 of the slidable access control device 12. The shifter 98 is moved downhole until the shifting profile 102 engages the opening shifting profile 106. Once so engaged, the shifter 98 is then moved downhole along the longitudinal axis of the wellbore. As this is done, the follower 122 moves along the first cam **118*a*, which is preferably a helical slot and the second cam 120*a*, which is preferably a substantially straight slot. The downhole movement of follower 122 along the second cam 120*a* simultaneously forces the follower 122 along the first cam 118*a*, thereby rotating the slidable access control device 12 about the longitudinal axis of the bushing 16 and opening the window 12. When the window is opened, sufficient force is applied to the shifter 98 to cause it to disengage from the opening shifting profile 106** as previously discussed above.

When the window 14 is in the open position and further operations require that the window be closed, the shifter 98 is, again, run into the wellbore 10 on a wireline. In those instance where the shifter 98 is reversible as discussed above, it is imperative that the shifter 98 be oriented so that the shifting profile 102 will engage the closing shifting profile 110 of the slidable access control device 12. The shifter 98 is moved uphole until the shifting profile 102 engages the closing shifting profile 110. Once so engaged, the shifter 98 is then moved uphole along the longitudinal axis of the wellbore 10. As this is done, the follower 122 moves along the first cam 118*a*, and the second cam 120*a*. The uphole movement of follower 122 along the second cam 120*a* (e.g., straight slot) simultaneously forces the follower 122 along the first cam 118*a* (e.g., helical slot), there by rotating the slidable access control device 12 about the longitudinal axis of the bushing 16 and closing the window 14. When the window 14 is closed, sufficient force is applied to the shifter 98 to cause it to disengage from the closing shifting profile 110 as previously discussed above.

From the above, it is apparent that the present invention provides a subterranean structure for controlling tool access to a lateral wellbore extending from a wellbore. The subterranean structure comprises a bushing that is located in the wellbore and proximate an opening to the lateral wellbore and that has an access window therethrough for allowing access by a tool to the lateral well through the opening. The bushing further has a slidable access control device coaxially coupled thereto. Also included is a shifter that is engageable with the slidable access control device to cause the slidable access control device to slide between an open position wherein a tool is allowed to pass through the window and the opening and into the lateral wellbore and a closed position wherein the tool is prevented from passing through the window and the opening and into the lateral wellbore. A distinct advantage of this particular invention over those of the prior art is that the window is sufficiently large to pass tools therethrough and provides adequate room to properly operate the tools. The prior art circulation/production devices discussed above, of course, do not possess these advantages because it is not feasible to have openings large enough to accommodate tools such as completion, production or work-over devices as such openings would interfere with proper operation of the circulation/production devices.

The present invention also provides a method of controlling tool access to a lateral wellbore extending from a wellbore. The preferred method comprises the steps of: 1)locating a bushing in the wellbore proximate an opening to the lateral wellbore, the bushing having an access window therethrough for allowing access by a tool to the lateral wellbore through the opening, the bushing further having a slidable access control device coaxially coupled thereto; 2)engaging the slidable access control device with a shifter to slide the slidable access control device with respect to the bushing; and 3) sliding the slidable access control device between an open position wherein a tool is allowed to pass through the window and the opening and into the lateral wellbore and a closed position wherein the tool is prevented from passing through the window and the opening and into the lateral wellbore.

Although the present invention and its advantages have been described in detail, those skilled in the art should understand that they can make various changes, substitutions and alterations herein without departing from the spirit and scope of the invention in its broadest form.

What is claimed is:

1. A method of controlling tool access to a lateral wellbore extending from a wellbore, comprising the steps of:

locating a bushing in said wellbore proximate an opening to said lateral wellbore, said bushing having an access window therethrough for allowing access by a tool to said lateral wellbore through said opening, said bushing further having a slidable access control device coaxially coupled thereto;

actuating said slidable access control device with a shifter to slide said slidable access control device with respect to said bushing; and sliding said slidable access control device between an open position wherein a tool is allowed to pass through said window and said opening and into said lateral wellbore and a closed position wherein said tool is prevented from passing through said window and said opening and into said lateral wellbore.

2. The method as recited in claim 1 wherein a seal is coupled to one of said slidable access control device and said bushing and said method further comprises the step of disengaging said seal from one of said slidable access control device and said bushing when said slidable access control device slides from said closed position to said open position.

3. The method as recited in claim 2 further comprising the step of re-engaging said seal with one of said slidable access control device and said bushing when said slidable access control device slides from said open position to said closed position.

4. The method as recited in claim 1 wherein said step of actuating said slidable access control device with said shifter includes the step of engaging a shifting profile associated with said slidable access control device to slide said slidable access control device between said open and closed positions.

5. The method recited in claim 4 wherein said step of engaging a shifting profile includes engaging an opening shifting profile to slide said slidable access control device from said closed position to said open position.

6. The method as recited in claim 4 wherein said step of engaging a shifting profile includes engaging a closing shifting profile to slide said slidable access control device from said open position to said closed position.

7. The method as recited in claim 1 further comprising the step of setting a deflector within said wellbore into a diverting position to divert said tool from said wellbore and into said lateral wellbore.

8. The method as recited in claim 7 wherein said shifter is coupled to said deflector and said step of setting said deflector includes the step of engaging an opening shifting profile with said shifter and sliding said slidable access control device from said closed position to said open position.

9. The method as recited in claim 7 wherein said step of setting said deflector includes the step of orienting and locking said deflector with an orienting lock coupled to said deflector.

10. The method as recited in claim 9 wherein said orienting mad locking step includes positioning said orienting lock into an orienting and locking profile coupled to said bushing.

11. The method as recited in claim 1 further comprising the step of removing a deflector from said wellbore.

12. The method as recited in claim 11 wherein said shifter is coupled to said deflector and said step of removing said deflector includes the step of engaging a closing shifting profile with said shifter and sliding said slidable access control device from said open position to said closed position.

13. The method as recited in claim 1 wherein said step of actuating said slidable flow control device with said shifter includes the step of coupling said shifter to an actuator.

14. The method as recited in claim 13 wherein said step of coupling said shifter to said actuator includes coupling said shifter to said actuator wherein said actuator is selected from the group consisting of a running tool, a pulling tool and a wireline tool.

15. The method as recited in claim 1 wherein said step of sliding includes rotating said slidable access control device about a longitudinal axis of said bushing with said shifter.

16. The method as recited in claim 15 wherein said step of rotating includes the step of sliding a shifting sleeve coupled to said slidable access control device along a longitudinal axis of said wellbore to rotate said slidable access control device about a longitudinal axis of said bushing with said shifting sleeve.

17. The method as recited in claim 16 wherein said step of sliding includes directing a follower through cams associated with said shifting sleeve and said slidable access control device, said cams positioned relative to one another to slide said slidable access control device by rotating said slidable access control device about a longitudinal axis of said bushing between said open and closed positions as said shifting sleeve is slid along said longitudinal axis of said wellbore.

18. The method as recited in claim 17 wherein said step of directing a follower includes concurrently moving a camming lug along a first cam associated with said shifting sleeve and a second cam associated with said slidable access control device, said camming lug extending through said first and second cams, said first and second cams offset at a predetermined angle with respect to one another.

19. The method as recited in claim 18 wherein said step of moving said camming lug along said first cam includes moving said camming lug along a slot formed in and along a longitudinal axis of said shifting sleeve and said step of moving said camming lug along said second cam includes moving said camming lug along a helical slot formed in and around a longitudinal axis of said slidable access control device.

20. The method as recited in claim 16 wherein said step of sliding includes rotating said slidable access control device about 120° about said longitudinal axis of said bushing.

21. The method as recited in claim 15 wherein said step of sliding said slidable access control device with said shifter includes the step of engaging a shifting profile of said slidable access control device with said shifter to slide said shifting sleeve along said longitudinal axis of said wellbore and thereby rotate said slidable access control device between said open and closed positions.

22. The method as recited in claim 21 wherein said step of engaging said shifting sleeve with said shifter includes engaging an opening shifting profile of said shifting sleeve to rotate said slidable access control device from said closed position to said open position.

23. The method as recited in claim 21 wherein said step of engaging said shifting sleeve with said shifter includes engaging a closing shifting profile of said shifting sleeve to rotate said slidable access control device from said open position to said closed position.

24. A subterranean structure for controlling tool access to a lateral wellbore extending from a wellbore, comprising:

a bushing located in said wellbore and proximate an opening to said lateral wellbore, said bushing having an access window therethrough for allowing access by a tool to said lateral well through said opening, said bushing further having a slidable access control device coaxially coupled thereto; and a shifter associated with said slidable access control device to cause said slidable access control device to slide between an open position wherein a tool is allowed to pass through said window and said opening and into said lateral wellbore and a closed position wherein said tool is prevented from passing through said window and said opening and into said lateral wellbore.

25. The subterranean structure as recited in claim 24 further comprising a seal coupled to one of said slidable access control device and said bushing, said seal disengaging from one of said slidable access control device and said bushing when said slidable access control device slides from said closed position to said open position and re-engaging one of said slidable access control device and said bushing when said slidable access control device slides from said open position to said closed position.

26. The subterranean structure as recited in claim 24 wherein said slidable access control device includes a shifting profile associated therewith, said shifter engagable with said shifting profile to slide said slidable access control device between said open and closed positions.

27. The subterranean structure as recited in claim 26 wherein said shifting profile includes an opening shifting profile, said shifter engagable with said opening shifting profile to slide said slidable access control device from said closed position to said open position.

28. The subterranean structure as recited in claim 26 wherein said shifting profile includes a closing shifting profile, said shifter engagable with said closing shifting profile to slide said slidable access control device from said open position to said closed position.

29. The subterranean structure as recited in claim 24 further comprising a deflector positionable within said wellbore to divert said tool from said wellbore and into said lateral wellbore.

30. The subterranean structure as recited in claim 29 wherein said shifter is coupled to said deflector and said shifter is configured to engage an opening shifting profile to slide said slidable access control device from said closed position to said open position as said deflector is positioned within said wellbore.

31. The subterranean structure as recited in claim 29 wherein said shifter is configured to engage a closing shifting profile to slide said slidable access control device from said open position to said closed position as said deflector is removed from said wellbore.

32. The subterranean structure as recited in claim 29 wherein said deflector includes an orienting lock coupled to said deflector to thereby orient and lock said deflector in a diverting position with respect to said lateral wellbore.

33. The subterranean structure as recited in claim 32 wherein said bushing includes an orienting and locking profile coupled to said bushing, said orienting and locking profile configured to engage said orienting lock to thereby orient and lock said deflector in said diverting position with respect to said lateral wellbore.

34. The subterranean structure as recited in claim 24 further comprising an actuator configured to engage said shifter.

35. The subterranean structure as recited in claim 34 wherein said actuator is selected from the group consisting of a running tool, a pulling tool and a wireline tool.

36. The subterranean structure as recited in claim 24 wherein said shifter further comprises a shifting sleeve coupled to said slidable access control device and having a shifting profile associated therewith, said shifting sleeve positioned along a longitudinal axis of said wellbore for reciprocal movement with respect thereto to rotate said slidable access control device about a longitudinal axis of said bushing.

37. The subterranean structure as recited in claim 36 further wherein said shifter includes a shifting profile configured to engage said shifting profile of said shifting sleeve to reciprocate said shifting sleeve along said longitudinal axis of said wellbore.

38. The subterranean structure as recited in claim 37 wherein said shifting sleeve includes an opening shifting profile configured to engage said shifting profile of said shifter to reciprocate said shifting sleeve along said longitudinal axis of said wellbore and thereby rotate said slidable access control device from said closed position to said open position.

39. The subterranean structure as recited in claim 37 wherein said shifting sleeve includes a closing shifting profile configured to engage said shifting profile of said shifter to reciprocate said shifting sleeve along said longitudinal axis of said wellbore and thereby rotate said slidable access control device from said opened position to said closed position.

40. The subterranean structure as recited in claim 36 further comprising a follower extending through cams associated with said shifting sleeve mad said slidable access control device, said cams positioned relative to one another and configured to allow said follower to concurrently move through said cams to thereby slide said slidable access control device by rotating said slidable access control device about a longitudinal axis of said bushing between said open and closed positions as said shifting sleeve is reciprocated along said longitudinal axis of said wellbore.

41. The subterranean structure of claim 40 wherein said follower causes said slidable access control device to rotate about 120° with respect to said longitudinal axis of said bushing.

42. The subterranean structure as recited in claim 40 wherein said follower is a camming lug extending through and coupling a first cam associated with said shifting sleeve and a second cam associated with said slidable access control device, said first and second cams offset at a predetermined angle with respect to one another.

43. The subterranean structure as recited in claim 42 wherein said first cam is a slot formed in and along a longitudinal axis of said shifting sleeve and said second cam is a helical slot formed in and around a longitudinal axis of said slidable access control device.

44. The subterranean structure as recited in claim 25 wherein said slidable access control device has a fluid port formed therethrough that is alignable with a fluid port formed through said bushing, to thereby establish fluid communication between said bushing and said wellbore.

45. A subterranean structure for controlling tool access to a lateral wellbore extending from a wellbore, comprising:

a bushing located in said wellbore and proximate an opening to said lateral wellbore, said bushing having an access window therethrough for allowing access by a tool to said lateral wellbore through said opening;

a slidable access control device coaxially coupled to said bushing for reciprocal movement along a longitudinal axis of said bushing and having a shifting profile associated therewith; and a shifter associated with said slidable access control device and engageable with said shifting profile to slide said slidable access control device along a longitudinal axis of said bushing between an open position wherein a tool is allowed to pass through said window and said opening and into said lateral wellbore and a closed position wherein said tool is prevented from passing through said window and said opening and into said lateral wellbore.

46. The subterranean structure as recited in claim 45 further comprising a seal coupled to one of said slidable access control device and said bushing, said seal disengaging from one of said slidable access control device and said bushing when said slidable access control device reciprocates from said closed position to said open position and re-engaging one of said slidable access control device and said bushing when said slidable access control device reciprocates from said open position to said closed position.

47. The subterranean structure as recited in claim 45 wherein said shifting profile includes an opening shifting profile and a closing shifting profile, said shifter releasably engagable with said opening shifting profile and said closing shifting profile to slide said slidable access control device between said open and closed positions.

48. The subterranean structure as recited in claim 47 further comprising a deflector positionable within said wellbore to divert said tool from said wellbore and into said lateral wellbore.

49. The subterranean structure as recited in claim 48 wherein said shifter is coupled to said deflector and said shifter is configured to engage said opening shifting profile to slide said slidable access control device from said closed position to said open position as said deflector is moved downhole within said wellbore.

50. The subterranean structure as recited in claim 48 wherein said shifter is coupled to said deflector and said shifter is configured to engage said closing shifting profile to slide said slidable access control device from said opening position to said closed position as said deflector is moved uphole within said wellbore.

51. The subterranean structure as recited in claim 48 wherein said deflector includes an orienting lock coupled to said deflector to thereby orient and lock said deflector in a diverting position with respect to said lateral wellbore.

52. The subterranean structure as recited in claim 51 wherein said bushing includes an orienting and locking profile coupled to said bushing, said orienting and locking profile configured to engage said orienting lock to thereby orient and lock said deflector in said diverting position with respect to said lateral wellbore.

53. The subterranean structure as recited in claim 45 further comprising an actuator configured to engage said shifter.

54. The subterranean structure as recited in claim 53 wherein said actuator is selected from the group consisting of a running tool, a pulling tool and a wireline tool.

55. The subterranean structure as recited in claim 45 wherein said bushing is coupled to a honed bore having a bore diameter less than a bore diameter of said bushing and said shifter further comprises a biased shifter key, said shifter key having a profile configured to engage said shifting profile and having an engaging position and a non-engaging position, said bore diameter of said honed bore configured to deploy said shifter key into said engaging position.

56. The subterranean structure of claim 55 further comprising a covering sleeve configured to slidably cover said shifter key as said shifter is run into said wellbore, said covering sleeve having dogs associated therewith engageable with said honed bore to slide said covering sleeve to a non-covering position, to thereby allow said shifter key to deploy into said engaging position.

57. A subterranean structure for controlling tool access to a lateral wellbore extending from a wellbore, comprising:

a bushing located in said wellbore and proximate an opening to said lateral wellbore, said bushing having an access window therethrough for allowing access by a tool to said lateral wellbore through said opening;

a slidable access control device coaxially coupled to said bushing;

a shifting sleeve coupled to said slidable access control device and having a shifting profile, said shifting sleeve positioned along a longitudinal axis of said wellbore for reciprocal movement with respect thereto to rotate said slidable access control device about a longitudinal axis of said bushing; and a shifter engageable with said shifting profile of said shifting sleeve to cause said slidable access control device to rotate between an open position wherein a tool is allowed to pass through said window and said opening and into said lateral wellbore and a closed position wherein said tool is prevented from passing through said window and said opening and into said lateral wellbore.

58. The subterranean structure as recited in claim 57 further comprising a follower extending through cams associated with said shifting sleeve and said slidable access control device, said cams positioned relative to one another and configured to allow said follower to concurrently move through said cams to thereby slide said slidable access control device by rotating said slidable access control device about a longitudinal axis of said bushing between said open and closed positions as said shifting sleeve is slid along said longitudinal axis of said wellbore.

59. The subterranean structure of claim 58 wherein said follower causes said slidable access control device to rotate about 120° with respect to said longitudinal axis of said bushing.

60. The subterranean structure as recited in claim 58 wherein said follower is a camming lug coupling a first cam associated with said shifting sleeve and a second cam associated with said slidable access control device, said camming lug extending through said first and second cams, said first and second cams offset at a predetermined angle with respect to one another.

61. The subterranean structure as recited in claim 60 wherein said first cam is a slot formed in and along a longitudinal axis of said shifting sleeve mad said second cam is a helical slot formed in and around a longitudinal axis of said slidable access control device.

62. The subterranean structure as recited in claim 57 wherein said shifter includes a shifting profile configured to engage said shifting profile of said shifting sleeve to rotate said slidable access control device between said open mad closed positions.

63. The subterranean structure as recited in claim 62 wherein said shifting sleeve includes an opening shifting profile configured to engage said shifting profile of said shifter, to thereby rotate said slidable access control device from said closed position to said open position.

64. The subterranean structure as recited in claim 62 wherein said shifting sleeve includes a closing shifting profile configured to engage said shifting profile of said shifter, to thereby rotate said slidable access control device from said opened position to said closed position.

* * * * *